US005391076A

United States Patent [19]

Home

[11] Patent Number: 5,391,076

[45] Date of Patent: Feb. 21, 1995

[54] GAS BURNER FOR OUTDOOR BARBECUING DEVICE

[76] Inventor: William Home, 9-3 Fl., No. 374, Sec. 2, Pa Teh Rd., Taipei, Taiwan, Prov. of China

[21] Appl. No.: 27,193

[22] Filed: Mar. 5, 1993

[51] Int. Cl.[6] ..... F23D 14/62

[52] U.S. Cl. ..... 431/354; 431/351; 126/39 E; 126/41 R

[58] Field of Search ..... 431/354, 125, 351; 126/41 R, 39 E

[56] References Cited

U.S. PATENT DOCUMENTS

| | | | |
|---|---|---|---|
| 3,416,733 | 12/1968 | Leighton | 431/354 X |
| 4,305,372 | 12/1981 | Hahn | 431/354 X |
| 4,553,524 | 11/1985 | Wheat et al. | 126/41 R |
| 4,561,419 | 12/1985 | Koziol | 126/41 R |
| 4,679,544 | 7/1987 | Koziol | 126/41 R |
| 4,846,671 | 7/1989 | Kwiatek | 126/39 E X |
| 4,919,116 | 4/1990 | Pfefferkorn | 126/41 R |
| 4,986,254 | 1/1991 | Haen et al. | 126/41 R |

FOREIGN PATENT DOCUMENTS

| | | | |
|---|---|---|---|
| 102809 | 8/1980 | Japan | 431/354 |

*Primary Examiner*—Larry Jones
*Attorney, Agent, or Firm*—Marshall A. Lerner

[57] ABSTRACT

A gas burner has a domed head for shielding a plurality of gas outlets which are provided along the periphery of the gas burner. The gas outlets extend outward to perform the burning function. A flange extends outward along a periphery of the domed head and a skirt extends downward from and along a periphery of the flange. The bottom of the skirt is preferably 2 mm high above the gas outlets in order not to interfere with the flow of the gas.

2 Claims, 2 Drawing Sheets

GAS BURNER FOR OUTDOOR BARBECUING DEVICE

BACKGROUND OF THE INVENTION

The present invention relates to a gas burner and, more particularly, to an improved gas burner which has a skirt extending along a peripheral flange thereof.

Early gas burners generally had upwardly-extending gas outlets for cooking food. Nowadays the gas outlets of a gas burner generally extend outward and are provided along the periphery of the gas burner to prevent the gas outlets from being splashed upon and thus blocked by soup being cooked. In the case where the gas burner is positioned in an oven or below a barbecue grill, a domed head is provided so that the fat may flow downward along the domed head in order not to block the outlets. It is, however, found that the gas outlets are still blocked when cooking relatively greasy food as the viscous fat has a relatively strong adhesion and thus may flow along an underside of the domed head, causing an inefficient combustion and the food cannot be well cooked within the preset time.

Therefore, there has been a long and unfulfilled need for an improved gas burner to mitigate and/or obviate the above-mentioned problems.

SUMMARY OF THE INVENTION

In accordance with the present invention, a gas burner generally has a domed head for shielding a plurality of gas outlets which are provided along the periphery of the gas burner. The gas outlets extend outward to perform the burning function. A flange extends outward along a periphery of the domed head and a skirt extends downward from and along a periphery of the flange. The bottom of the skirt is preferably 2 mm high above the gas outlets in order not to interfere with the flow of the gas. When cooking, the viscous fat flows downward along the domed head and then the skirt, not blocking or interfering the operation of the gas outlets.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
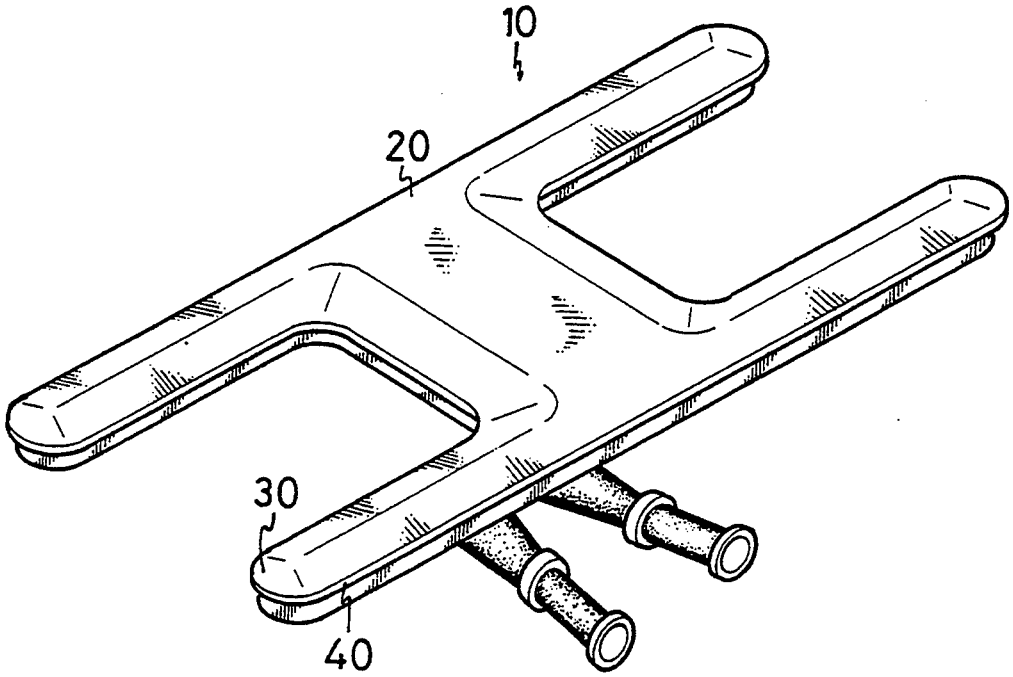
FIG. 1 is a perspective view of a gas burner in accordance with the present invention.
Figure 3:
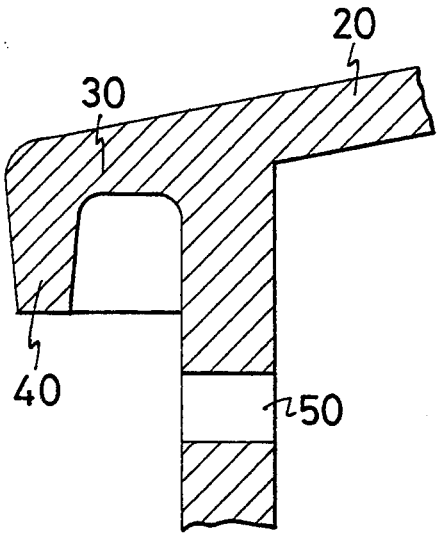
FIG. 3 is an enlarged view illustrating the downward-extending skirt of the gas burner.
Figure 2:
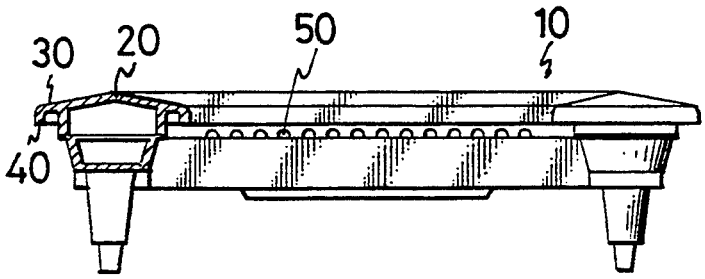
FIG. 2 is a partly-sectioned side elevational view taken from the left side of the gas burner in FIG. 1.

Referring to FIGS. 1 through 3, a gas burner 10 generally has a domed head 20 for shielding a plurality of gas outlets 50 which are provided along the periphery of the gas burner 10. The gas outlets 50 extend outward to perform the burning function, as shown in FIGS. 2 and 3. A flange 30 extends outward along a periphery of the domed head 20 and a skirt 40 extends downward from and along a periphery of the flange 30. As shown in FIG. 3, the bottom of the skirt 40 is preferably 2 mm high above the gas outlets 50 in order not to interfere with the flow of the gas. As can be seen in the drawings, when cooking, the viscous fat flows downward along the domed head 20 and then the skirt 40, not blocking or interfering the operation of the gas outlets.

In this embodiment, a H-shaped gas burner is illustrated. It is appreciated that other types of gas burners may add the feature of the invention to prevent the gas outlets from being blocked.

Although the invention has been explained in relation to its preferred embodiment, it is to be understood that many other possible modifications and variations can be made without departing from the spirit and scope of the invention as hereinafter claimed.

I claim:

1. A gas burner comprising a domed head, a plurality of gas outlets provided along the periphery of said gas burner and extending outwardly, a flange extending outwardly along a periphery of said domed head, a skirt extending downwardly from and along a periphery of said flange, and a recess formed between said flange and said skirt.

2. The gas burner as claimed in claim 1 wherein said skirt extends downwardly a distance which is larger than the thickness of said gas burner.

* * * * *